United States Patent [19]

Ryan et al.

[11] 4,090,109

[45] May 16, 1978

[54] GAS DISCHARGE COUPLING OF DRIVING CIRCUITRY TO A GAS DISCHARGE DISPLAY/MEMORY PANEL

[75] Inventors: William H. Ryan, Toledo, Ohio; William E. Johnson, Temperance, Mich.

[73] Assignee: Owens-Illinois, Inc., Toledo, Ohio

[21] Appl. No.: 730,037

[22] Filed: Oct. 6, 1976

[51] Int. Cl.[2] ..... H05B 37/00

[52] U.S. Cl. ..... 315/169 TV; 313/201; 340/166 EL; 340/324 M

[58] Field of Search ..... 313/201; 315/169 R, 315/169 TV; 340/166 EL, 324 M

[56] References Cited

U.S. PATENT DOCUMENTS

| | | | |
|---|---|---|---|
| 3,749,971 | 7/1973 | Petty | 315/169 TV |
| 3,795,908 | 3/1974 | McDowell et al. | 340/324 M |
| 3,940,755 | 2/1976 | Shutoh | 340/324 M |
| 3,958,233 | 5/1976 | Schermerhorn | 340/166 EL |

*Primary Examiner*—S. C. Buczinski
*Attorney, Agent, or Firm*—Donald Keith Wedding

[57] ABSTRACT

A gas discharge display/memory device in which the driving circuitry is coupled to the panel electrodes through a plurality of gas discharge cells. Along one edge of each of the panel electrode arrays, there are formed a plurality of gas discharge shift cells each defined by a pair of crosspoints, one crosspoint formed by one of a plurality of shift electrodes and a common electrode means and the other crosspoint formed by the common electrode means and one of the panel electrodes. The shift electrodes associated with each electrode array are connected to individual shift voltage generators which generate phased shift voltages to shift a discharge along the common electrode. The discharge associated with each electrode array can be transferred to a selected panel electrode by applying a transfer pulse voltage to the electrodes forming the second crosspoint such that a discharge is initiated in the panel cell defined by the crosspoint of the selected panel electrodes. A sustainer generator is connected to both electrode arrays through a plurality of gas discharge sustainer cells defined by the crosspoints formed by a sustainer electrode and all of the panel electrodes of one of the electrode arrays for each electrode array. The sustainer generator applies a voltage to all of the panel cells to maintain a sequence of discharges in any panel cell in which a discharge has been initiated.

16 Claims, 4 Drawing Figures

GAS DISCHARGE COUPLING OF DRIVING CIRCUITRY TO A GAS DISCHARGE DISPLAY/MEMORY PANEL

BACKGROUND OF THE INVENTION

1. Field of the Invention

The present invention relates to the use of gas discharge cells to couple driving circuitry to a gas discharge display/memory device.

2. Description of the Prior Art

In the prior art, multiple gas discharge display/memory panels have been proposed in the form of a pair of dielectric charge storage members which are backed by electrodes, the electrodes being so formed and oriented with respect to an ionizable gaseous medium as to define a plurality of discrete gas discharge units or cells. The cells have been defined by a surrounding or confining physical structure such as the walls of apertures in a perforated glass plate sandwiched between glass surfaces and they have been defined in an open space between glass or other dielectric backed with conductive electrode surfaces by appropriate choices of the gaseous medium, its pressure and the electrode geometry. In either structure, charges (electrons and ions) produced upon ionization of the gas volume of a selected discharge cell, when proper alternating operating voltages are applied between the opposed electrodes, are collected upon the surface of the dielectric at specifically defined locations. These charges constitute an electrical field opposing the electrical field which created them so as to reduce the voltage and terminate the discharge for the remainder of the cycle portion during which the discharge producing polarity remains applied. These collected charges aid an applied voltage of the polarity opposite that which created them in the initiation of a discharge by imposing a total voltage across the gas sufficient to again initiate a discharge and a collection of charges. This repetitive and alternating charge collection and ionization discharge constitutes an electrical memory.

In one form of panel construction, the electrodes are arranged in arrays, typically in parallel lines with the arrays of lines othogonally related, to define in the region of the projected intersections as viewed along the common perpendicular to each array a plurality of opposed pairs of charge storage areas on the surfaces of the dielectric bounding or confining the gas. Information can be stored and displayed by writing (initiating a discharge) at a selected location. For example, driving and addressing circuitry connected to the electrode arrays energizes a vertical electrode and a horizontal electrode which define the selected cell to generate a potential difference across the cell equal to or greater than the ignition potential of the gas. Such a method of addressing requires a separate addressing circuit for each electrode or a multiplexed addressing circuit in which a group of electrodes are connected to a common addressing circuit. Furthermore, a control circuit must be provided for selectively activating the desired addressing circuits. If selective erasing of the cells is also desired, additional circuitry is required to change the polarity of the addressing signal or change the timing so that the addressing voltage is in opposition to the sustainer voltage to develop a potential sufficient to cause a discharge in an "on state" cell and draw the charges from the dielectric surfaces such that the cell will be in the "off state".

An alternate form of addressing circuitry provides for a shifting of the information to be stored wherein the information is written in a designated portion of the panel and then shifted along the vertical and horizontal electrodes to the selected cells. The shifting addressing system is generally less expensive to manufacture, operate and repair than the above-described individual and multiplexing addressing circuits. A gas panel for use in selectively shifting information is disclosed in U.S. Pat. No. 3,795,908 issued to A. W. McDowell and F. M. Lay on Mar. 5, 1974. The panel includes a pair of orthogonally related electrode arrays arranged on opposite sides of an envelope filled with gas to define a matrix of individual gas discharge cells. An additional vertical electrode is provided along which information can be written by applying an addressing voltage between the additional vertical electrode and one or more horizontal electrodes which define cells only along the additional vertical electrode. Once the information has been written, it can be shifted into the matrix and along the vertical and horizontal electrodes.

The wall charge developed in the written cell spreads to adjacent cells to condition them. The conditioned cells can then be written by applying a shift voltage having a potential intermediate the sustainer voltage and the write voltage. The conditioned cells have a lower ignition voltage and are written when the shift voltage is applied whereas unconditioned cells remain in the "off state". Information can be shifted along the vertical or horizontal axes by applying a repetitive sequence of phased shift signals to sets of electrodes in the arrays. For example, if each set in an array includes three successively spaced electrodes and three phased shift signals are applied to respective electrodes of each set, the information will be shifted along an electrode of the other array in the direction of the order of the shift signals. When the information reaches the selected cell, the shift signals are removed and a sustainer signal maintains the selected cell in the "on state".

Another form of data shift panel is disclosed in U.S. Pat. No. 3,958,233 issued May 18, 1976 in the name of J. D. Schermerhorn. The driving circuitry includes at least three periodic potential sources with at least two of the sources being in phase with respect to each other and out of phase with respect to at least one of the remaining sources. A first set of spaced electrodes in one of the electrode arrays is connected to a first one of the potential sources; a second set of electrodes in the array is connected to a second one of the potential sources, each electrode of the second set being adjacent one of the electrodes of the first set; and a third set of electrodes in the array is connected to a third one of the potential sources, each electrode of the second set being intermediate an electrode of the first set and an electrode of the third set.

A further potential source is connected to at least one electrode of the other electrode array and combines with the two in phase potential sources to form a first composite wave form. The first wave form causes discharge sequences to occur at two adjacent discharge cells near the crosspoint vicinity of adjacent electrodes when at least one cell has been in a discharge state in an immediately preceding time interval or causes no discharge to occur at adjacent discharge cells when neither cell has been in a dischage state in an immediately preceding time interval or causes no discharge to occur at adjacent discharge cells when neither cell has been in a discharge state in an immediately preceding time interval. Another potential source which is out of phase with the in phase potential sources is connected to at least one electrode of the one electrode array wherein the further potential source combines with each out of phase potential source to form a second composite wave form which prohibits the continuance of a discharge at a cell near the crosspoint vicinity of an electrode connected to the out of phase potential source.

Therefore, the panel and driving circuitry disclosed in the patent No. 3,958,233 is arranged to maintain at least two discharge sites in a state of discharge during the shifting of such sites across a display and during the stable state, as opposed to the previously described prior art devices which utilize one discharge site for the stable state and two discharge sites in the on state only during the transitional periods incident to shifting a discharge site on the panel. Such a panel has a much better visual resolution of images because the spacing required for off state shift electrodes is reduced to a single electrode between information light spots on the panel face. If the electrodes of the other array are paired, four adjacent discharge sites can be maintained in the discharge state during shifting and during the stable state.

The information to be displayed is entered on a pilot electrode which is a pair of adjacent electrodes connected together at the input ends. A transfer electrode is positioned intermediate the pilot electrode and the first electrode of the one electrode array to transfer the input data to the array electrode so that it can be shifted to the desired position. The electrodes of the other array are extended into proximity with the pilot electrode so that input data can be positioned along the pilot electrode by pulsing the electrode along which the data is to be shifted.

Although both of the above-described gas discharge display/memory devices feature gas discharge coupling of the input data to the panel, the shifting and sustaining voltage circuits are directly connected to the panel electrodes. The present invention reduces the number of connections between the panel electrodes and the driving circuitry by utilizing gas discharge cell coupling.

SUMMARY OF THE INVENTION

The present invention concerns a gas discharge display/memory device wherein the driving circuitry is coupled to the panel electrodes through gas discharge cells. Positioned along one edge of each electrode array or axis is a plurality of multi-electrode d.c. discharge cells for coupling the addressing and shifting circuits to the panel. Each cell includes two pairs of opposed electrodes, an addressing electrode and a shift electrode in the first pair and a transfer electrode and an array electrode in the second pair. The addressing electrode is common to all the multi-electrode cells on one axis and is connected to a source of an addressing voltage. The shift electrodes are each connected to one of three phased shift voltage sources such that the shift voltages can be applied in sequence from one cell to the next. A discharge is initiated at one end of the addressing electrode by pulsing the address voltage source at the start of the scan when the first phased voltage is applied to the shift electrode at that end of the addressing electrode. The discharge is shifted along the addressing electrode as each phased voltage is applied in sequence to the shift electrodes.

Like the addressing electrodes, the transfer electrode is common to all of the multi-electrode cells on one axis and is connected to a source of a transfer voltage. The opposed electrode in the second pair is the terminal portion of an electrode in the electrode array of that axis. When the discharge has been shifted to the multi-electrode cell which includes the terminal portion of the array electrode along which the cell to be written is located, the transfer electrode is pulsed with the transfer voltage source to couple the discharge to the array electrode. If the same procedure is followed on the other axis, the cell defined by the cross point of the two array electrodes will be written. Such a device has an advantage over the prior art shifting devices in that it provides random access to any cell in the panel while prior art devices shift the discharge across the panel from cell to cell to the selected cell.

The sustainer voltage circuit is also coupled to the electrode arrays by gas discharge cells. Positioned along the opposite edge of each electrode array is a plurality of sustainer cells which include a sustainer electrode and an array electrode. The sustainer electrode is common to all of the sustainer cells and is connected to the sustainer voltage source. Thus the sustainer voltage is simultaneously applied to all of the electrodes in both arrays to maintain the discharge in the written cell. The sustainer cells function as bi-directional voltage limiters allowing the array electrode to be driven from the sustainer voltage potential to the sustainer potential plus twice the discharge voltage limit.

The addressing discharge can be stopped at the array electrode to which the discharge is to be transferred by cycling back and forth between the phase voltage associated with that array electrode and one of the other phase voltages. An alternate method of stopping the addressing discharge would be to stop the shifting sequence at the desired array electrode and pulse the associated phase voltage at a rate fast enough to reignite the discharge from the residual ionization from the previous discharge.

The present invention provides a means by which a gas discharge display/memory panel can be coupled to the driving circuitry with a minimum number of connections. The phase voltage circuits require three connections, one for each phase voltage, and the addressing circuit, transfer circuit and sustaining circuit each require one connection for a total of six connections on each axis or a total of twelve connectors in the circuit.

It is an object of the present invention to provide a gas discharge display/memory panel addressing circuit that is less expensive to manufacture, operate and repair than prior art addressing circuits.

DESCRIPTION OF THE PREFERRED EMBODIMENT

Figure 1:
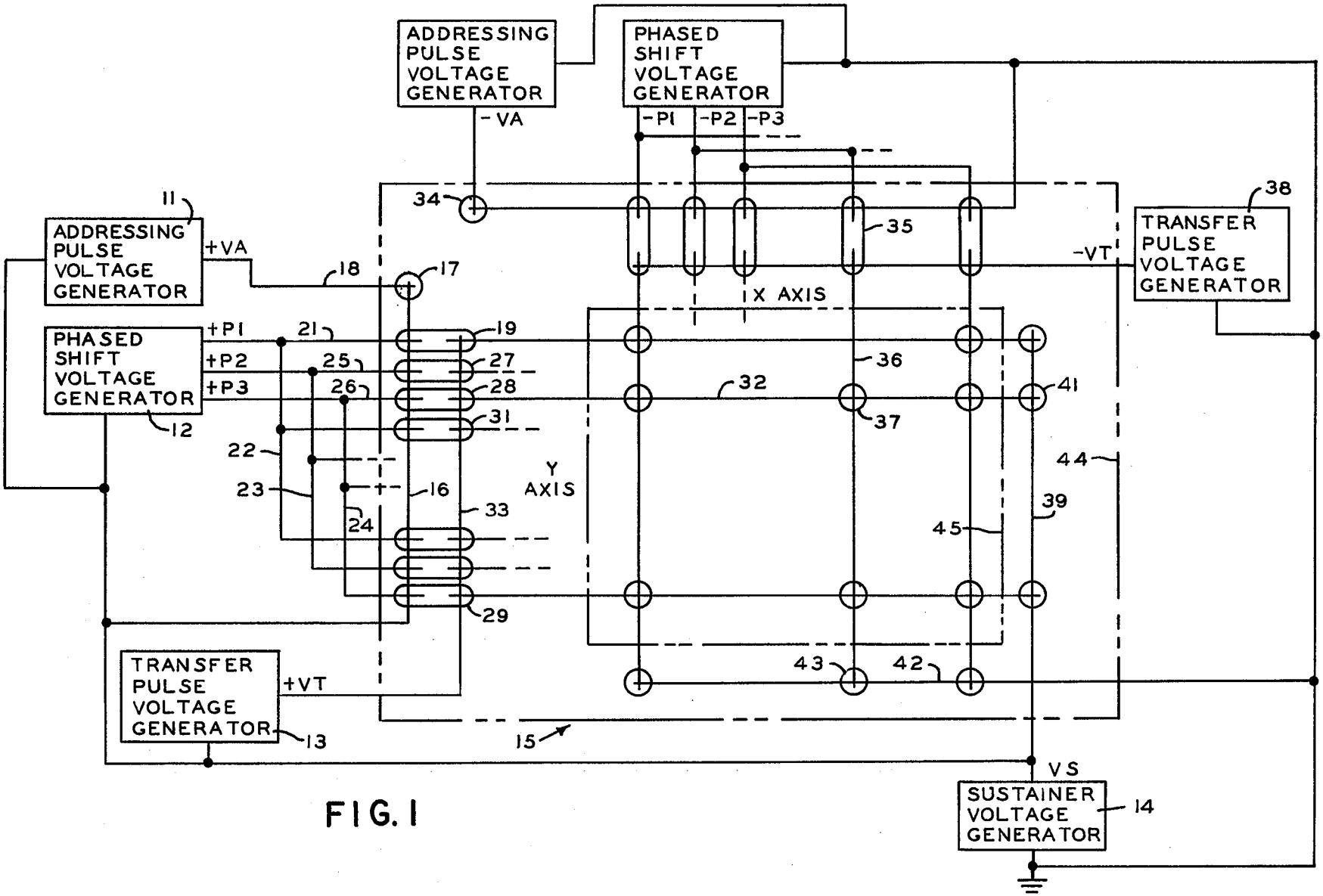
FIG. 1 is a partial schematic, partial block diagram of a gas discharge display/memory panel and driving circuitry according to the present invention.

There is shown in FIG. 1 a partial schematic, partial block diagram of a gas discharge display/memory panel and associated driving circuitry according to the present invention. An addressing pulse voltage generator 11, a phased shift voltage generator 12, a transfer pulse voltage generator 13 and a sustainer voltage generator 14 are each coupled to a Y axis electrode array of a panel 15 through d.c. discharge cells located about the periphery of the panel. The X axis electrode array is similarly connected to an addressing generator, a shift generator, a transfer generator and the sustainer generator 14 and is not discussed in detail. The addressing generator 11 initiates a discharge in a starter cell to condition an adjacent shift cell. A plurality of shift cells each have a first crosspoint defined by a common addressing electrode and one of a plurality of shift electrodes and a second crosspoint defined by a common transfer electrode and one of the Y axis array electrodes. The shift electrodes are connected to receive shift signals from the generator 12 to shift the discharge from one shift cell to another in sequence along the addressing electrode. When the discharge has been shifted to the shift cell associated with the desired array electrode, the shifting is stopped and the discharge conditions the second crosspoint of the shift cell whereupon the transfer generator 13 initiates a discharge. The similar generators of opposite polarity connected to the X axis electrode array are also activated to shift a discharge to a desired X axis array electrode. The X axis and Y axis discharges are transferred simultaneously to initiate a discharge in the panel cell defined by the crosspoint of the two panel electrodes. The discharge in the panel cell is maintained by the application of the sustainer voltage to all of the panel cells by the sustainer generator 14 through a plurality of d.c. gas discharge cells.

An addressing electrode 16 for the Y axis electrode array of the panel 15 is connected to the sustainer generator 14 output lead to receive the VS sustainer voltage wave form. The addressing electrode defines a starting d.c. cell 17 at its crosspoint with a start electrode 18 connected to the output lead of the addressing generator 11. The generator 11 has a reference lead connected to the output lead of the sustainer generator 14 so that the addressing pulse voltage +VA is added to the sustainer voltage VS. When it is desired to write a panel cell, the generator 11 is activated to apply the +VA addressing pulse voltage across the starting cell 17 and initiate a discharge therein.

The addressing electrode 16 also defines a plurality of multi-electrode shift cells at its crosspoints with a plurality of shift electrodes. For example, a first shift cell 19, adjacent the starting cell 17, has one crosspoint defined by the addressing electrode 16 and a shift electrode 21 connected to a +P1 shift voltage line 22. The line 22 in turn is connected to the +P1 shift voltage output lead of the phased shift voltage generator 12 and to every third shift electrode along the Y axis of the panel 15. The reference lead of the shift generator is connected to the output lead of the sustainer generator 14. Although the +P1 shift voltage potential is not sufficient to cause a discharge by itself, a discharge will result if the shift cell has been conditioned by a discharge in an adjacent cell. Therefore, if the +P1 shift voltage is generated when the discharge is initiated in the starting cell 17, the discharge will be shifted to the shift cell 19.

The +P2 and +P3 shift voltage output leads of the shift generator 12 are connected to a pair of lines 23 and 24 respectively. The +P2 line 23 is connected to a shift electrode 25 and the +P3 line 24 is connected to a shift electrode 26 wherein the shift electrodes 25 and 26 and the addressing electrode 16 define a crosspoint of a second shift cell 27 and a third shift cell 28 respectively. The shift voltages +P1, +P2 and +P3 are cyclic wave forms which are phased with respect to one another so that +P2 lags +P1 and +P3 lags +P2. The discharge in the shift cell 19 conditions the cell 27 such that a discharge is initiated in the cell 27 when the +P2 shift voltage is generated. The discharge in the shift cell 27 then conditions the shift cell 28 such that a discharge is initiated in the cell 28 when the +P3 shift voltage is generated. The discharge will continue to be shifted along the addressing electrode 16 as the shift voltages are generated in sequence until a discharge is generated in a last Y axis shift cell 29 or the shifting is stopped at one of the other shift cells.

The shifting can be stopped at a desired shift electrode by either alternating between two of the shift voltages or by pulsing one of the shift voltages at a rate sufficient to maintain a sequence of discharges. For example, if it is desired to stop at the shift electrode 26 of the shift cell 28, the shift generator 12 is directed to generate the +P1, +P2 and +P3 shift voltages in sequence and then alternately generate the +P2 and +P3 shift voltages to shift the discharge between the shift cells 27 and 28. The shift generator 12 could instead alternately generate the +P1 and +P3 shift voltages to shift the discharge between an adjacent shift cell 31 and the shift cell 28. In the alternative, the shift sequence could be stopped at the +P3 shift voltage which then would be pulsed to maintain a sequence of discharges in the shift cell 28.

After the discharge generated by the addressing pulse voltage has been shifted to the desired shift cell, the discharge is ready to be transferred to a Y axis panel electrode associated with the shift cell. A terminal portion of one end of a Y axis electrode 32 extends into the shift cell 28 to form a crosspoint with a transfer electrode 33 which is common to all of the Y axis shift cells. The transfer electrode 33 is connected to the output lead of the transfer pulse voltage generator 13 which has its reference lead connected to the output lead of the sustainer voltage generator 14. At the same time the discharge was being shifted along the Y axis shift cells, similar circuitry was shifting a discharge initiated in an X axis starting cell 34 along a plurality of X axis shift cells. For, example, the X axis discharge could have been shifted to a shift cell 35 associated with an X axis panel electrode 36. The crosspoint of the electrodes 32 and 36 defines a panel cell 37 which is to be written. When the discharges have been stopped at the shift cells 28 and 35, the transfer generator 13 is activated to transfer the Y axis discharge to the electrode 32 and an X axis transfer generator 38 is activated to transfer the X axis discharge to the electrode 36. The simultaneous transfer of the discharges then initiates a discharge in the panel cell 37 which can be maintained by the sustainer voltage wave form. The panel can also be addressed by timing the arrival of the discharge on each axis at the respective electrodes 32 and 36 to coincide with the activation of the transfer generators. Such operation can be accomplished by delaying the initiation of the discharge in the starting cell for the axis having the shorter shifting path until each discharge is the same number of electrodes from the electrodes defining the selected cell.

The output lead of the sustainer generator 14 is connected to a Y axis sustainer electrode 39 which is common to a plurality of Y axis sustainer d.c. cells. The crosspoint of the panel electrode 32 and the sustainer electrode 39 defines a sustainer cell 41. The reference lead of the sustainer generator 14 is connected to the system ground potential and to an X axis sustainer electrode 42 which is common to a plurality of X axis sustainer cells. The crosspoint of the panel electrode 36 and the sustainer electrode 42 defines a sustainer cell 43 which along with the sustainer cell 41 completes a circuit for applying the sustainer voltage wave form across the panel cell 37.

The sustainer voltage wave form is simultaneously applied to all of the panel cells through the sustainer cells. The spacing of the electrodes defining the sustainer cells is such that the sustainer cells break down at a lower voltage than the panel cells to apply the sustaining voltage across the panel cells without initiating a discharge in the panel cells. Although the sustaining voltage potential is sufficient to initiate a discharge in the sustainer cells, it is not sufficient to initiate a discharge in the panel cells. However, the sustainer voltage will maintain a discharge in the panel cells once that discharge has been initiated by the transfer generators. The sustainer cells function as bidirectional voltage limiters allowing the panel electrodes to be driven from the normal sustaining voltage to a maximum potential of the sustaining voltage plus twice the discharge voltage limit of a sustainer cell. The discharge voltage limit being the voltage drop across a cell maintained in the discharged state. For example, if the sustainer generator 14 is generating a positive polarity wave form with respect to the circuit ground potential, the voltage on the panel electrode 32 will be less positive than the voltage on the sustainer electrode by the amount of the discharge voltage limit of the sustainer cell 41. When the +VT transfer pulse voltage is generated, the panel electrode 32 can be driven to a maximum of two sustainer cell discharge voltage limits wherein the voltage across the sustainer cell 41 will be reversed.

The panel 15 is divided into two areas defined by an outer phantom line 44 and an inner phantom line 45. The outer line 44 represents the periphery of the gas containing envelope wherein all of the gas discharge cells are located. The area between the lines 44 and 45 locates all of the d.c. gas discharge starting, shift and sustainer cells and the area inside the line 45 locates all of the a.c. gas discharge panel cells. A d.c. cell is characterized by having the defining crosspoint portions of the electrodes exposed to the gas. Each discharge in a d.c. cell must be initated by the application of a firing voltage since a d.c. cell has no dielectric charge storage surfaces positioned between the panel electrodes and the gas. The a.c. panel cells include a dielectric charge storage surface positioned between at least one electrode array and the gas wherein a first discharge generates a stored charge which aids the sustainer voltage in initiating a second discharge. A sequence of discharges can be continued indefinitely in an a.c. cell by the application of the sustainer wave form.

Typically, the envelope is a single undivided volume bounded by two parallel glass plates with a seal between the edges thereof. However, the envelope could be divided by forming a wall along the line 45 to separate the d.c. cells from the a.c. cells where it is desired to provide a different gas mixture for each group of cells. Furthermore, it is to be understood that the starting, shift and sustainer cells can be a.c. gas discharge cells although d.c. cells have been disclosed in the preferred embodiment.

Figure 2:
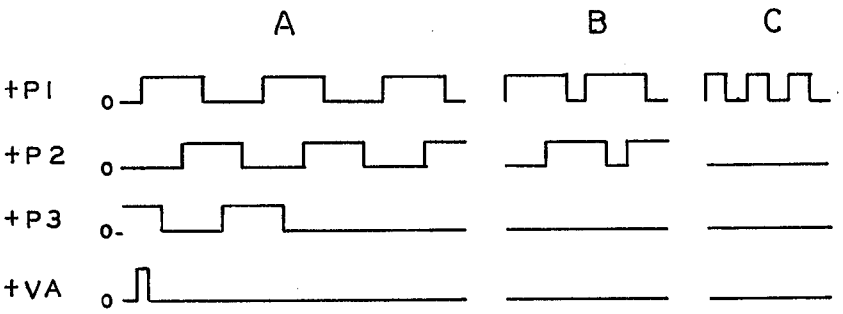
FIGS. 2 and 3 are diagrams of the wave forms associated with the circuitry of FIG. 1.

FIG. 2 is a wave form diagram of the signals generated by the circuitry of FIG. 1. In column A there is shown the normal phased sequence of the +P1, +P2 and +P3 shift voltage wave forms for which the "O" reference level is the VS sustainer voltage. The addressing generator is activated to generate a +VA pulse voltage to the starting cell to initiate a discharge at the time the +P1 shift voltage is generated wherein the discharge is shifted to the first shift cell. The +P2 and +P3 shift voltages are then generated to shift the discharge to the second and third shift cells respectively. When the +P1 shift voltage is again generated, the discharge is shifted to the fourth shift cell along the addressing electrode. If it is desired to stop the discharge, for example at the fourth cell, the generation of the +P3 shift voltage can be discontinued and the +P1 and +P2 shift voltages will shift the discharge back and forth between the fourth and fifth shift cells. In some cases the frequency of the shift voltage wave forms is such that the conditioning from a previous discharge will not persist until the next cycle of the second shift voltage when a discharge is to be shifted back and forth between two shift cells. Therefore, the shift voltage wave forms may have to be modified to overlap during the time the shift is stopped as shown in column B of FIG. 2 where the +P1 and +P2 shift voltages overlap. An alternate method of stopping the discharge is to cycle the shift voltage applied to the designated shift cell at a rate sufficient to maintain a series of discharges. As shown in column C, the +P1 shift voltage is cycled at an increased frequency while the +P2 and +P3 shift voltages are discontinued. The wave forms for the Y axis are similar.

Figure 3:
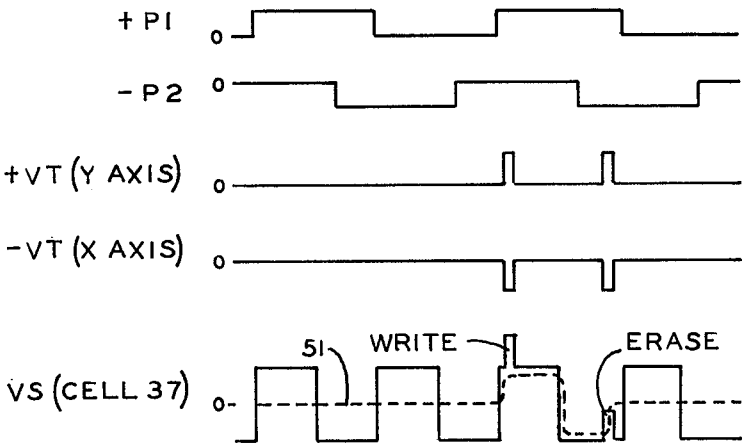

When it is desired to transfer the discharge to the panel electrode, the +VT pulse voltage is generated during the application of the +P1 shift voltage and the −VT pulse voltage is generated at the same time during the application of the −P2 shift voltage to simultaneously transfer the discharges to the panel electrodes 32 and 36 respectively. The VS sustainer wave form is applied across the panel cell 37 as shown in FIG. 3. A dashed line 51 represents the wall voltage of the cell 37. Before the transfer pulse voltages are generated, the wall voltage is at a neutral level intermediate the extremes of the sustainer voltage wave form. Although a symmetrical sustainer wave form is shown, various types of asymetrical sustainer wave forms could be utilized. When the transfer pulse voltages +VT and −VT are generated, there will be a discharge initiated in each of the shift cells 28 and 35 to apply the total transfer pulse voltage less the discharge voltage of each shift cell across the panel cell 37. The applied transfer voltage plus the sustainer voltage initiates a discharge to write the panel cell 37. The panel cell wall voltage is driven in the direction of the sustainer voltage as a wall charge is built to terminate the discharge. The wall charge aids the sustainer voltage in succeeding cycles of the sustainer wave form to initiate an continuing series of discharges. The panel cell 37 can be erased by transferring the discharges during that portion of the sustainer voltage wave form which is opposite in polarity to the transfer pulse voltage to initiate a discharge in the panel cell and draw off the wall charge so that the cell in the "off state" as shown.

Figure 4:
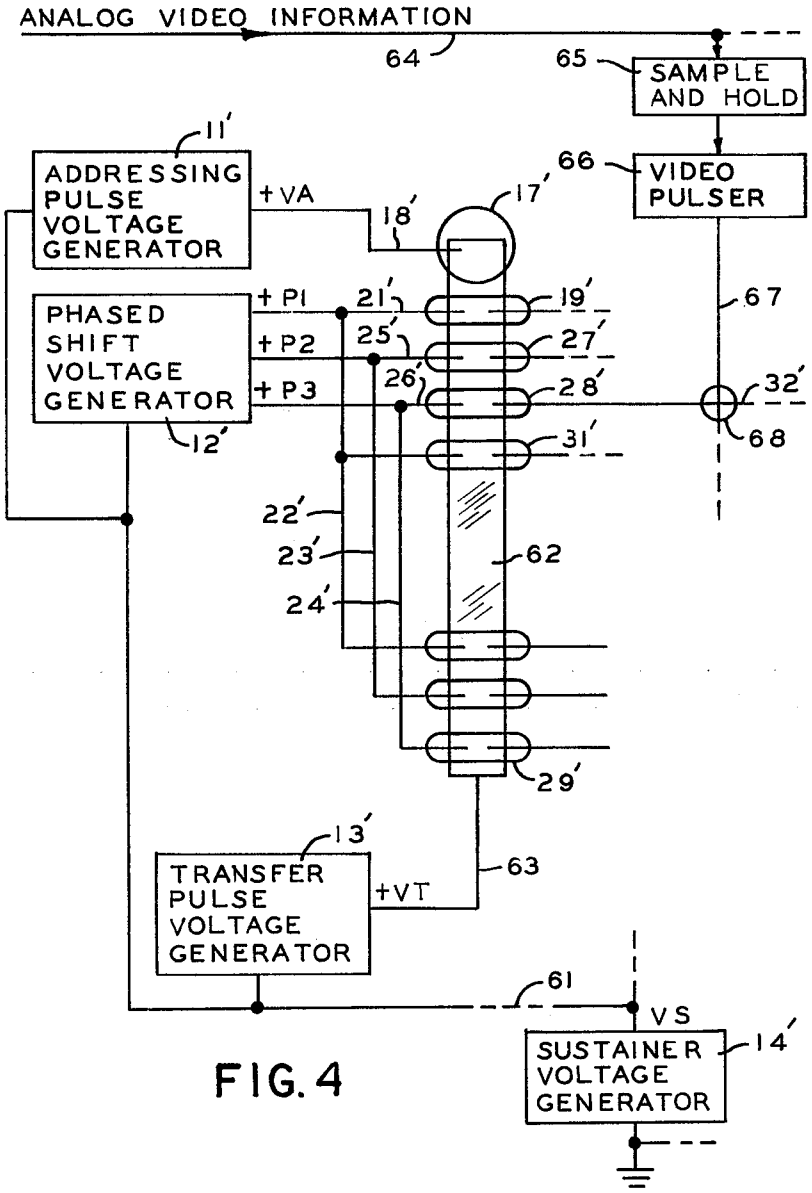
FIG. 4 is a partial schematic, partial block diagram of a portion of an alternate embodiment of the present invention showing the shift cells.

There is shown in FIG. 4 a portion of a partial schematic, partial block diagram of an alternate embodiment of the present invention. An addressing pulse voltage generator 11', a phased shift voltage generator 12' and a transfer pulse voltage generator 13', which are similar to the generators 11, 12 and 13 respectively of FIG. 1, each have a reference lead connected to the output lead of a sustainer voltage generator 14' by a line 61. The shift generator 12' has a +P1 shift voltage output lead connected to a line 22', a +P2 shift voltage output lead connected to a line 23' and a +P3 shift voltage output lead connected to a line 24'. A first shift cell 19' has a shift electrode 21' connected to the line 22', a second shift cell 27' has a shift electrode 25' connected to the line 23' and a third shift cell 28' has a shift electrode 26' connected to the line 24'.

The addressing generator 11' has an output lead connected to a start electrode 18' for supplying the +VA addressing pulse voltage to a starting cell 17'. The starting cell 17' is defined by the crosspoint of the start electrode 18' and a pulser electrode 62. The pulser electrode 62 is a relatively wide electrode which is common to all of the shift electrodes and performs the functions of the addressing electrode 16 and the transfer electrode 33 of FIG. 1. The end of the pulser electrode 62 opposite the starting cell 17' is connected to an output lead 63 of the transfer pulse voltage generator 13'. When the generator 13' is not generating a transfer pulse, the line 63 is connected to the line 61 to complete a circuit for the addressing generator 11' and the shift generator 12'. If the addressing generator 11' is activated to generate the +VA pulse voltage when the shift generator 12' is generating the +P1 shift voltage, a discharge will be initiated in the starting cell and will be shifted to the shift cell 19'. Subsequent generation of shift voltages will shift the discharge along the pulser electrode 62 to the shift cells 27', 28', 31' and finally to the shift cell 29' in sequence unless the discharge is stopped at one of the shift cells.

The pulser electrode 62 is also connected to the output lead 63 of the transfer generator 13' to receive the +VT pulse voltage. When the discharge has been stopped at a desired shift cell, the transfer generator 13' is activated to transfer the discharge to the associated panel electrode. For example, if the discharge is stopped at the shift cell 28', the +VT pulse voltage will initiate a discharge at the crosspoint of the pulser electrode 62 and a panel electrode 32'. If the X axis panel electrodes are connected to a similar circuit, a simultaneous activation of the transfer generators will initiate a discharge in a selected panel cell.

There is shown in FIG. 4 a portion of the circuitry which can be utilized with the present invention to display video information. An input line 64 is connected to a source (not shown) of an analog video information signal which is to be displayed on a gas discharge display/memory panel. The video information is coupled to the X axis electrode array through a plurality of sample and hold and video pulser circuits as disclosed in U.S. patent application Ser. No. 671,163, filed Mar. 29, 1976 in the name of William H. Ryan and incorporated herein by reference. For example, the line 64 is connected to an input of a sample and hold circuit 65 which has an output connected to an input of a video pulser circuit 66 having an output connected to an X axis panel electrode 67. The crosspoint of the electrodes 32' and 67 defines a panel cell 68 which is to be written with selected video information.

According to the above-identified application, Ser. No. 671,163, the analog video information signal is sampled at predetermined time intervals by each of the sample and hold circuits and the samples are stored as potentials proportional to the magnitude of the video signal at the moment of sampling. Trigger signals are then generated by the video pulsers form the samples, each trigger signal having a wave form with at least one dimension proportional to the potential of the associated sample. The sustainer voltage generator 14' is reset function as a maintain voltage generator which applies a maintain voltage having a magnitude somewhat less than the lower limit of the sustainer voltage which is normally utilized. Thus a cell cannot be turned "on" in the normal sense of initiating a sequence of discharges which continues indefinitely. However, the application of the trigger voltage can initiate a sequence of discharges which continues for a substantial number of cycles of the maintain voltage wave form before dying out. The number of cycles for which the discharge sequence persists depends on the magnitude and duration of the addressing trigger voltage.

In FIG. 4, the sample and hold circuit 65 includes a means (not shown) for storing a sample of the analog video signal wherein the sample has a potential proportional to the magnitude of the video signal when the sample is stored. When all the samples for the X axis have been stored, the video pulsers, such as the video pulser 66 connected to the panel electrode 67, generate trigger signals from the stored samples and apply the trigger signals to the X axis electrode array. The video pulsers are activated at the same time the discharge is initiated in the shift cell associated with the Y axis panel electrode along which it is desired to write the video information. The transfer generator is activated to transfer the discharge to the Y axis panel electrode and each of the panel cells defined by the crosspoints of the Y axis panel electrode and all of the X axis panel electrodes are written. The maintain voltage wave form is applied to all of the panel cells to maintain a sequence of discharges for a number of cycles of the maintain signal proportional to the selected dimension of the trigger signals.

The generation of the shift voltages can be timed to coincide with the time required to sample and write one line of video information in the generation of a standard television picture. The standard television picture in the United States is scanned in 1/30 of a second wherein one field of 262.5 lines is traced from the top to the bottom of the picture and then a second field of lines is traced between the lines of the first field such that the two fields are interlaced. Interlacing makes it possible to avoid noticeable flicker while using the lowest repetition frequency for the picture that will satisfactorily portray motion. The shift voltage can be applied to the shift cell associated with the selected Y axis panel electrode and when the video information is stored, the transfer generator and the video pulsers are simultaneously activated to initiate discharges along the selected Y axis panel electrode. Then the addressing discharge is shifted to the shift cell associated with the next Y axis panel electrode which is to be written.

In summary, the present invention concerns a gas discharge display device which includes a gas discharge display/memory panel and driving circuitry therefor wherein the driving circuitry and panel are coupled together through a plurality of gas discharge cells. The panel includes an envelope containing an ionizable gaseous medium and a pair of opposing electrode arrays transversely oriented so as to define a matrix of gas discharge panel cells within the gaseous medium in the vicinity of the crosspoints of the opposed panel electrodes, the panel electrodes of at least one of the arrays being insulated from the gaseous medium by at least one dielectric member. The driving circuitry includes a means for generating an addressing pulse voltage for initiating a discharge in a selected one of the panel cells and means for generating a sustainer voltage to maintain a sequence of discharges in the selected cell. The coupling cells can be either d.c. or a.c. gas discharge cells and are each defined by a crosspoint of one of the panel electordes of the electrode arrays and an electrode connected to the driving circuitry.

The means for generating a sustainer voltage includes a sustainer generator means having an output lead connected to a first sustainer electrode and reference lead connected to a second sustainer electrode. The plurality of coupling cells includes a first plurality of sustainer cells defined by the crosspoints of the first sustainer electrode and the panel electrodes of one of the electrode arrays and a second plurality of sustainer cells defined by the crosspoints of the second sustainer electrode and the panel electrodes of the other one of the electrode arrays. The sustainer cells have a lower discharge voltage than the other coupling cells and the panel cells.

The means for generating an addressing pulse voltage includes a separate addressing circuit for each of the electrode arrays. The addressing circuit for the one electrode array includes a means for initiating a conditioning discharge which can be a gas discharge starting cell defined by the crosspoint of a start electrode and a common electrode means and an addressing pulse voltage generating means connected between the start electrode and the common electrode means for applying the addressing pulse voltage to the starting cell to initiate a discharge.

The plurality of coupling cells also includes a plurality of shift cells each defined by a pair of crosspoints, a first one of the crosspoints formed by one of a plurality of shift electrodes and the common electrode means and a second one of the crosspoints formed by one of the panel electrodes of the one electrode array and the common electrode means. One of the shift cells is adjacent the starting cell such that when the discharge is initiated in the starting cell, the one shift cell is conditioned.

The addressing circuit for the one electrode array includes a means connected to the shift electrodes and to the common electrode means for initiating an addressing discharge in the one conditioned shift cell and for shifting the addressing discharge to adjacent ones of the shift cells in sequence along the common electrode means by initiating discharges at the first crosspoints. Furthermore, a means is connected to the common electrode means and to the panel electrodes of the one electrode array for transferring the addressing discharge to a selected panel electrode of the one electrode array.

The means for initiating and shifting an addressing can be a means for cyclically generating at least three out of phase shift voltages having potentials insufficient to initiate a discharge in the shift cells. The shift generator means is connected to the shift electrodes and the common electrode means for applying the shift voltages to alternate ones of the shift electrodes in sequence whereby the shift voltage applied to the one shift cell when it is conditioned initiates a discharge at the first crosspoint of the one shift cell which is shifted along the common electrode means as the shift voltages initiate a discharge at the first crosspoint in each of the shift cells in sequence. The shift generator means stops the shifting of the discharge at the shift cell having its second crosspoint defined by the common electrode means and a selected panel electrode of the one electrode array.

The addressing circuit for the one electrode array also includes means connected to the common electrode means and to the panel electrodes of the one electrode array for transferring the addressing discharge to a selected panel cell electrode. A means for generating a transfer pulse voltage is connected between the common electrode means and the first sustainer electrode. The transfer generating means applies the transfer pulse voltage to initiate a discharge at the second crosspoint which has been conditioned by the addressing discharge at the first crosspoint to apply the transfer pulse voltage to the selected panel electrode.

Means is also provided for applying a pulse voltage to a panel electrode selected from the other electrode array whereby the transfer pulse voltage and the pulse voltage initiate a first discharge in the selected panel cell defined by the crosspoint of the selected panel electrodes of each electrode array. In one embodiment, the means for applying a pulse voltage includes an addressing circuit similar to the one described above with a starting cell, an addressing pulse voltage generating means, shift cells, a shift voltage generating means and a transfer pulse voltage generating means. In another embodiment, the panel electrodes of the other electrode array can be connected to video pulsers and sample and hold circuits for displaying analog video information.

In accordance with the provisions of the patent statutes, the principle and mode of operation of the invention have been explained and illustrated in its preferred embodiment. However, it must be understood that the invention may be practiced otherwise that as specifically illustrated and described without departing from its spirit or scope.

What is claimed is:

1. In a gas discharge display device including an envelope containing an ionizable gaseous medium and having a pair of opposing electrode arrays transversely oriented so as to define a matrix of gas discharge panel cells within the gaseous medium in the vicinity of the crosspoints of the opposed panel electrodes, the panel electrodes of at least one of the arrays being insulated from the gaseous medium by at least one dielectric member, and means for coupling driving circuitry to the electrode arrays, the driving circuitry including means for generating an addressing pulse voltage and shifting the voltage to a selected panel cell to initiate a discharge therein and means for generating a sustainer voltage to maintain a sequence of discharges in the selected cell, the improvement in the panel comprising: a plurality of gas discharge coupling cells each defined by at least one crosspoint of one of the electrodes of the electrode arrays and an electrode connected to the driving circuitry, at least two of said coupling cells being shift cells each connected between the addressing pulse voltage generating means and a respective one of said panel electrodes.

2. A gas discharge display panel according to claim 1 wherein said coupling cells are d.c. gas discharge cells.

3. A gas discharge display panel according to claim 1 wherein said coupling cells are a.c. gas discharge cells.

4. A gas discharge display panel according to claim 1 wherein the means for generating a sustainer voltage includes a sustainer generator having an output lead connected to a first sustainer electrode and a reference lead connected to a second sustainer electrode and wherein said plurality of coupling cells includes a first plurality of sustainer cells defined by the crosspoints of said first sustainer electrode and the panel electrodes of one of the electrode arrays and a second plurality of sustainer cells defined by the crosspoints of said second sustainer electrode and the panel electrodes of the other one of the electrode arrays.

5. A gas discharge display panel according to claim 4 wherein said sustainer cells have a lower discharge voltage than the panel cells.

6. A gas discharge display panel according to claim 1 wherein the means for generating an addressing pulse voltage includes means for initiating a conditioning discharge; said plurality of coupling cells includes a plurality of said shift cells each defined by a pair of crosspoints, a first one of said crosspoints formed by one of a plurality of shift electrodes and a common electrode means and a second one of said crosspoints formed by one of the panel electrodes of one of the electrode arrays and said common electrode means, one of said shift cells being adjacent said means for initiating a conditioning discharge such that said one shift cell is conditioned; means connected to said shift electrodes and to said common electrode means for initiating an addressing discharge in said one conditioned shift cell and for shifting said addressing discharge to adjacent ones of said shift cells in sequence along said common electrode means; means connected to said common electrode means and to the panel electrodes of said one electrode array for transferring said addressing discharge to a selected panel electrode of the one electrode array; and means connected to the other one of the electrode arrays for generating a pulse voltage on a selected one of the panel electrodes of the other electrode array whereby a discharge is initiated in the panel cell defined by the crosspoint of said selected panel electrodes.

7. A gas discharge display panel according to claim 6 wherein said common electrode means is a single, relatively wide pulser electrode forming a first one of said crosspoints with each one of said plurality of shift electrodes and forming a second one of said crosspoints with each of the panel electrodes of said one electrode array.

8. A gas discharge display panel according to claim 6 wherein said common electrode means includes an addressing electrode forming said first one of said crosspoints with each one of said plurality of shift electrodes and a transfer electrode forming said second one of said crosspoints with each one of the panel electrodes of said one electrode array.

9. A gas discharge display panel according to claim 1 wherein said plurality of coupling cells includes a plurality of said shift cells each defined by a pair of crosspoints, a first one of said crosspoints formed by one of a plurality of shift electrodes and a common electrode means and a second one of said crosspoints formed by one of the panel electrodes of one of the electrode arrays and said common electrode means, and a plurality of sustainer cells, each defined by the crosspoint of one of the panel electrodes of one of the electrode arrays and one of a pair of sustainer electrodes; wherein the addressing pulse voltage means includes a pair of addressing circuits, one connected to each of the electrode arrays, each of said addressing circuits including means for initiating a conditioning discharge to condition one of said shift cells, means connected to said shift electrodes of at least three of said shift cells including said one conditioned shift cell and to said common electrode means for initiating an addressing discharge in said one conditioned shift cell and for shifting said addressing discharge to adjacent ones of said connected shift cells in sequence along said common electrode means by initiating an addressing discharge at the next one of said first crosspoints conditioned by the previously initiated addressing discharge, and means connected to said common electrode means and to the panel electrodes defining said second crosspoints of said connected shift cells for transferring said addressing discharge to a selected one of said connected panel electrodes whereby the simultaneous transfer of said addressing discharge to said selected panel electrode of each electrode array initiates a discharge in the selected panel cell defined by the crosspoints formed by the selected panel electrodes; and wherein the means for generating a sustainer voltage includes a sustainer generator connected between said pair of sustainer electrodes for initiating a discharge in each of said sustainer cells and for maintaining a sequence of discharges in the selected panel cell after said discharge is initiated by said transferring means.

10. In a gas discharge display device including a gas discharge display/memory panel, the gas discharge panel including an envelope containing an ionizable gaseous medium and having a pair of opposing electrode arrays transversely oriented so as to define a matrix of gas discharge panel cells within the gaseous medium in the vicinity of the crosspoints of the opposed panel electrodes, the panel electrodes of at least one of the arrays being insulated from the gaseous medium by at least one dielectric member; circuitry for driving the panel; and means for coupling the driving circuitry to the panel, the coupling means and the driving circuitry comprising:

a gas discharge starting cell defined by the crosspoint of a start electrode and a common electrode means;

a means for generating an addressing pulse voltage, said addressing generator means being connected between said start electrode and said common electrode means for applying said addressing pulse voltage to said starting cell to initiate a discharge;

a plurality of gas discharge shift cells each defined by a pair of crosspoints, a first one of said crosspoints formed by one of a plurality of shift electrodes and said common electrode means and a second one of said crosspoints formed by one of the panel electrodes of one electrode array and said common electrode means, one of said shift cells being adjacent said starting cell such that the discharge initiated in said starting cell conditions said one shift cell;

means for cyclically generating at least three out of phase shift voltages having potentials insufficient to initiate a discharge in said shift cells, said shift generator means being connected to said shift electrodes and said common electrode means for applying said shift voltages to alternate ones of said shift electrodes in sequence whereby said shift voltage applied to said one shift cell when it is conditioned initiates a discharge at said first crosspoint which is shifted along said common electrode means as said shift voltages initiate a discharge at said first crosspoint in each of said shift cells in sequence; and wherein said shift generator means stops the shifting of the discharge at a one of said shift cells having its second crosspoint formed by said common electrode means and a selected panel electrode of said one electrode array;

means for generating a transfer pulse voltage, said transfer generating means being connected between said common electrode means and a first sustainer electrode;

a plurality of gas discharge sustainer cells each defined by the crosspoint of said first sustainer electrode and one of said panel electrodes of said one electrode array wherein said transfer generating means applies said transfer pulse voltage to initiate a discharge at said second crosspoint defined by said common electrode means and said selected panel electrode to apply said transfer pulse voltage to said selected panel electrode;

means for applying a pulse voltage to a panel electrode selected from the other electrode array whereby said transfer pulse voltage and said pulse voltage initiate a first discharge in selected panel cell defined by the crosspoint of said selected panel electrode of said one electrode array and said panel electrode selected from said other electrode array; and means for generating a sustainer voltage, said sustainer generator means being connected to said first sustainer electrode and all of the electrodes of said other electrode array for applying said sustainer voltage to all of the panel cells wherein a sequence of discharges is maintained in said selected panel cell after said first discharge is initiated.

11. A gas discharge display device according to claim 10 wherein said common electrode means includes an addressing electrode forming said first one of said crosspoints with each one of said plurality of shift electrodes and a transfer electrode forming said second one of said crosspoints with each one of the panel electrodes of said one electrode array.

12. A gas discharge display device according to claim 10 wherein said means for applying a pulse voltage generates a pulse voltage representing a sample of an analog video signal.

13. A gas discharge display device according to claim 12 wherein said means for applying a pulse voltage includes a source of an analog video signal, means connected to said source for sampling said video signal to obtain a sample having a potential proportional to the magnitude of said video signal when said sample was taken and for holding said sample, and video pulser means connected to said sample and hold means and to the panel electrodes of the other electrode array for generating said pulse voltage as a trigger-signal with at least one dimension proportional to the potential of said sample and wherein said sustainer generator means is reset to apply a maintain voltage to all of the panel cells having a magnitude somewhat less than the lower limit of said sustainer voltage to initiate a sequence of discharges which continues for a substantial number of cycles of said maintain voltage before dying out.

14. In a gas discharge display device including a gas discharge display/memory panel, the panel including an envelope containing an ionizable gaseous medium and having a pair of opposing electrode arrays transversely oriented so as to define a matrix of gas discharge panel cells within the gaseous medium in the vicinity of the crosspoints of the opposed panel electrodes, the panel electrodes of at least one of the arrays being insulated from the gaseous medium by at least one dielectric member; a driving circuit including means for initiating a discharge in a selected one of the panel cells and means for maintaining a sequence of discharges in the selected cell; and means for coupling the driving circuit to the panel electrodes, the improvement comprising: a plurality of gas discharge shift cells for coupling the driving circuit to one of the electrode arrays, each of said shift cells defined by a pair of crosspoints, a first one of said crosspoints formed by one of a plurality of shift electrodes and a common electrode means and a second one of said crosspoints formed by one of the panel electrodes of said one electrode array and said common electrode means, wherein the means for initiating a discharge in the selected cell includes means for initiating a conditioning discharge to condition the first crosspoint of one of said shift cells, means connected to said shift electrodes and to said common electrode means for initiating an addressing discharge at said conditioned first crosspoint and for shifting said addressing discharge to adjacent ones of said shift cells in sequence along said common electrode means by initiating an addressing discharge at the next one of the first crosspoints conditioned by the previously initiated addressing discharge, and means connected to the panel electrodes of said one electrode array and said common electrode means for transferring said addressing discharge to a selected one of the panel electrodes of said one electrode array by initiating a discharge at the second crosspoint formed by said common electrode means and said selected panel electrode after said second crosspoint has been conditioned by an addressing discharge at the first crosspoint of the one of said shift cells defined by said second crosspoint.

15. A gas discharge display device ccording to claim 14 including a first plurality of gas discharge sustainer cells defined by the crosspoints of a first sustainer electrode and the panel electrodes of one of the electrode arrays and a second plurality of gas discharge sustainer cells defined by the crosspoints of a second sustainer electrode and the panel electrodes of the other electrode array and wherein the maintaining means includes means for generating a sustainer voltage having an output lead connected to said first sustainer electrode and a reference lead connected to said second sustainer electrode whereby said sustainer voltage is applied to all of the panel cells to maintain a sequence of discharges in the selected panel cell and any other one of the panel cells in which a discharge has been initiated.

16. A gas discharge display device according to claim 15 wherein the discharge voltage of said sustainer cells is less than the discharge voltage of said shift cells at said second crosspoints.

* * * * *